US005838231A

United States Patent [19]

Scherbarth

[11] Patent Number: 5,838,231

[45] Date of Patent: Nov. 17, 1998

[54] DEVICE FOR MONITORING OPEN TERRAIN AND FOR PROTECTING OBJECTS

[75] Inventor: Stefan Scherbarth, Kanata, Canada

[73] Assignee: Senstar-Stellar Corporation

[21] Appl. No.: 907,626

[22] Filed: Aug. 8, 1997

Related U.S. Application Data

[63] Continuation of Ser. No. 731,135, Oct. 10, 1996, abandoned.

[30] Foreign Application Priority Data

Oct. 10, 1995 [DE] Germany ..... 195 37 632.3

[51] Int. Cl.[6] ..... G08B 1/08

[52] U.S. Cl. ..... 340/538; 340/550; 340/566; 340/552; 340/515

[58] Field of Search ..... 340/550, 566, 340/565, 552, 514, 515, 516, 538, 310.01, 825.06–825.13; 367/93, 94

[56] References Cited

U.S. PATENT DOCUMENTS

| | | | |
|---|---|---|---|
| 3,487,397 | 12/1969 | Kaplan | 340/515 |
| 4,206,449 | 6/1980 | Galvin et al. | 367/93 |
| 4,306,228 | 12/1981 | Meyer | 340/566 |
| 4,950,915 | 8/1990 | Spies et al. | 340/515 |
| 5,164,703 | 11/1992 | Rickman | 340/515 |
| 5,400,011 | 3/1995 | Sutton | 340/566 |

FOREIGN PATENT DOCUMENTS

| | | |
|---|---|---|
| 696 988 | 12/1978 | Belgium . |
| 1 201 505 | 3/1986 | Canada . |
| 0 049 202 | 4/1982 | European Pat. Off. . |
| 0 111 178 | 6/1984 | European Pat. Off. . |
| 2 367 325 | 5/1978 | France . |
| 11 56 004 | 10/1963 | Germany . |
| 26 00 798 | 7/1977 | Germany . |
| 31 42 705 | 5/1983 | Germany . |
| 2 110 446 | 6/1983 | United Kingdom . |

OTHER PUBLICATIONS

Brochure: "Korperschallmeldeanlage" (Body Sound Recording Device) VF 41; Cerberus Ristow, 1994. No.

"Lokales Sicherheits Netzwork in Gefahrenmeldeanlagen, Teil 2" (Local Security Network in Danger Recording Devices, Part 2); Telenorma, Bosch Telecom, Mar., 1974. No.

*Primary Examiner*—Jeffery A. Hofsass
*Assistant Examiner*—Sihong Huang
*Attorney, Agent, or Firm*—Pascal & Associates

[57] ABSTRACT

A monitoring device for detecting acoustic vibrations in monitored objects has a plurality of several structure-borne sound sensors which are connected to a remote central electronic analyzing system. The individual structure-borne sound sensors are each acoustically coupled with a self-testing unit, which can be activated from the central electronic analyzing system. Activation of the self-testing units is performed by modulation of an operating voltage supplied to structure-borne sound sensors, without additional electric connections to the electronic analysis system.

6 Claims, 3 Drawing Sheets

DEVICE FOR MONITORING OPEN TERRAIN AND FOR PROTECTING OBJECTS

This is a continuation of application Ser. No. 08/731,135, filed Oct. 10, 1996 now abandoned.

BACKGROUND AND SUMMARY OF THE INVENTION

This invention relates to a device for monitoring fences, doors, window grates or other similar objects.

For monitoring exterior facilities of buildings (fences, doors, window grates, etc.) to detect any unauthorized entry, signalling systems having structure-borne sound sensors are frequently used, with several such discrete sensors installed, for example, at regular distances on a metal fence. Detected sound signals are normally transmitted by cables to a central electronic analyzing system, or to several decentralized analyzing systems, where they are analyzed by means of specific algorithms in order to generate an alarm when sounds occur which are indicative of an unauthorized entry. Generally, for reasons of cost, several such sensors are connected electrically in parallel to form a signalling zone, and only the beep signal of the thus formed signalling zone is analyzed in the analyzing center. See, for example, German Patent Document DE 29 00 444 C2.

In order to increase the protective effect of the signalling system, and to offer protection against sabotage, the structure-borne sound sensor is frequently hidden, and located as inaccessibly as possible, for example, in a fence post.

For testing the overall function of the system, the facility is normally patrolled by a guard, and each individual sensor is excited (for example, by knocking) thus requiring a second guard to monitor the response of the signalling zone at the analyzing center. Devices are also known which permit testing without a second guard in the center, but patrolling of the facility is required, such as in the system disclosed in German Patent Document DE-P 44 35 997.7. Such manual testing is time consuming and costly. Moreover, when the sensors are hidden and inaccessible, it is sometimes impossible.

In other known systems, each of the individual structure-borne sensors is equipped with a self-testing unit, which can be activated by a central analyzing unit. One such system is the Polyp $^{(R)}$ VF41 (ASIC) structure-borne sound signalling system of the firm Cerberus Ristow, Karlsruhe, Deutschland, 1994. A disadvantage of these, devices, however, is that additional connection lines to the central analysis system are required to activate and supply current to the self-testing units.

It is an object of the present invention to provide a monitoring device which permits central testing of structure-borne sound detectors, and which requires minimal outlays for hardware, particularly for wiring.

This object is achieved by the monitoring system according to the invention, in which activation of the self-testing units (that is commencement of a self testing procedure) is achieved by modulation of the operating voltage of the structure-borne sound sensors. This self-testing arrangement thus requires no additional expenditures, either for mechanical installation or for wiring of the sensors, and can therefore also be used in the case of a mere double-pole connection of the sensors.

The structure-borne sound test excitation generated by the self-testing unit, is received by the sensor in exactly the same manner as the structure-borne sound of the object to be secured. It is then electrically transmitted by way of cables to the central electronic analyzing system and processed. Thus, in addition to the electronic system, the complete transducer and the overall construction are included in the test, which thus achieves a complete self-test.

In one embodiment of the invention, the self-testing unit is integrated in the housing of the structure-borne sound sensor, and is acoustically coupled with it. The structure-borne sound test excitation thus acts directly on the housing of the structure-borne sound sensor.

In another advantageous embodiment, the self-testing unit is arranged outside the housing, usually at a distance from the structure-borne sound sensor. In this case, the structure-borne sound test excitation acts upon the medium to be monitored, for example, a fence. The structure-borne sound test excitation is thus transmitted to the structure-borne sound sensor by way of the medium that is to be monitored. This construction has the additional advantage that the coupling of the structure-borne sound sensor to the medium which is to be monitored, can also be tested.

The sensors of a chain (signalling zone) can be connected with the central analysis unit in each case by way of separate power supply/signal lines, so that differentiation between the individual test signals is facilitated. Alternatively, when several sensors are arranged in parallel in a zone and are connected to a common supply line (and therefore also in the case of parallel-connected integrated self-testing units), all self-testing units in the central electronic analysis system are activated simultaneously by modulation of the supply voltage. To identify the test signals of individual sensors, a delay unit is provided within the sensors, or preferably within the self-testing unit, so that the testing structure-borne sound excitation takes place at different delay times, after the activating of the testing devices. These delay times are fixed before the mounting of the sensors according to the invention.

Other objects, advantages and novel features of the present invention will become apparent from the following detailed description of the invention when considered in conjunction with the accompanying drawings.

DETAILED DESCRIPTION OF THE DRAWINGS

Figure 1:
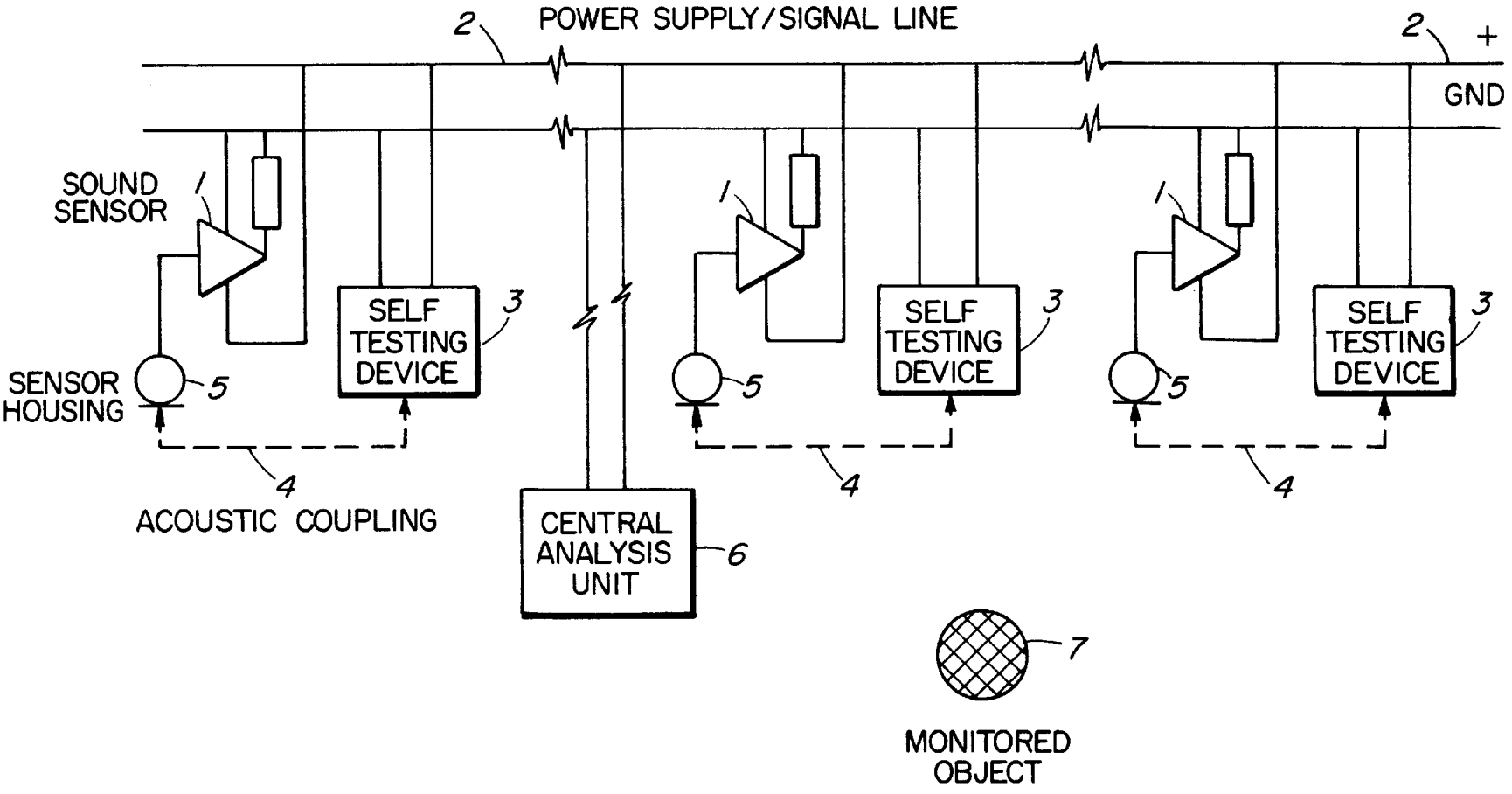
FIG. 1 is a schematic diagram of a structure-borne sound sensor contained in the device according to the invention.

FIG. 1 shows a structure-borne sound sensor 1, as contained in the device according to the invention. The sensor itself is connected to a central (usually remote) electronic analysis unit 6 by a power supply/signal line 2. The central analysis unit 6 is programmed to detect predetermined acoustic vibration patterns, particularly patterns indicative of an unauthorized manipulation of the monitored object 7. The sensors 1 and the assigned self-testing units 3 are operated by means of a fixed operating voltage.

The self-testing unit 3 is independent of the actual electronic sensor system, except that it is acoustically coupled with the sensor housing 5 by way of an acoustic coupling 4.

Figure 2:
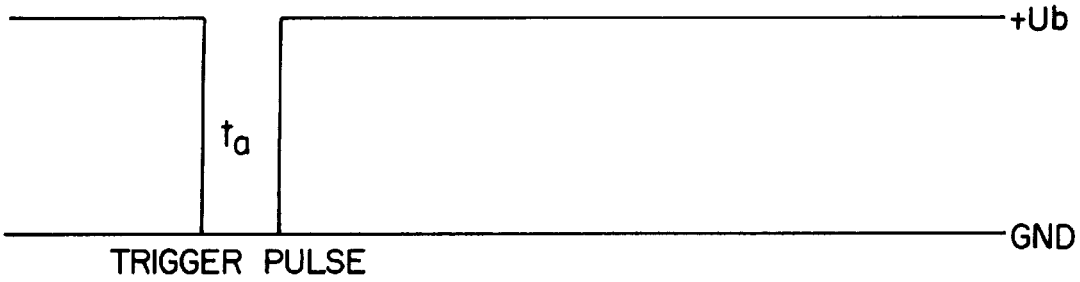
FIG. 2 is a time diagram for triggering the self-test.
Figure 3:
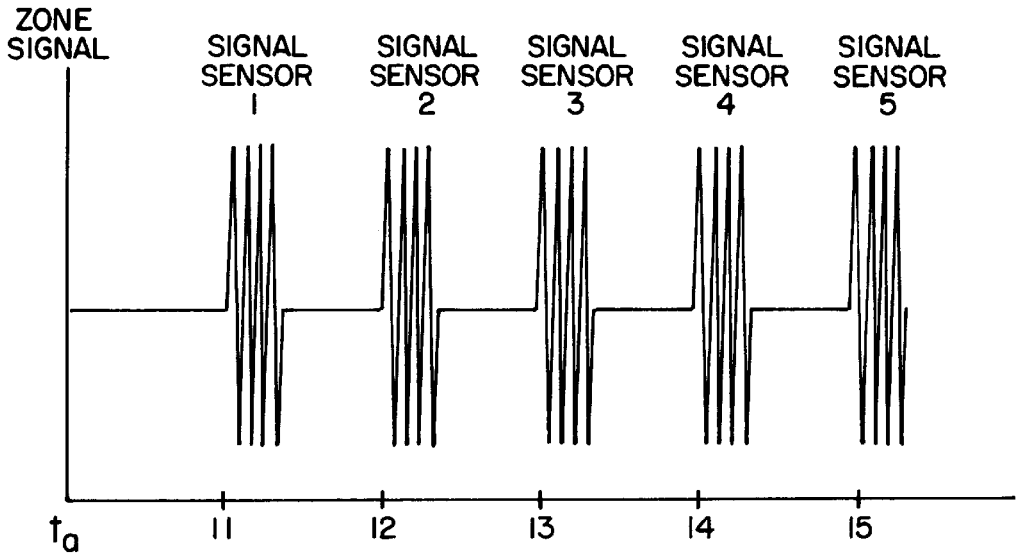
FIG. 3 is a time diagram of the test signals of several sensors arranged within the monitoring zone, with the self-test triggered at $t_a$.

The useful sensor signal is transmitted by modulation of the current consumption to the central analysis unit. The self-testing unit 3 is activated by zeroing out the operating voltage for a certain time $t_a$, as shown in FIG. 2. After different time periods $t_1$, $t_2$, $t_3$ . . . , the individual sensors of a zone are ordered to carry out a testing excitation. The resulting test signal generated by the respective sensors in a zone is illustrated in FIG. 3, so that the delay times $t_1$, $t_2$, $t_3$ etc. . . . permit an assignment of the test signals to the individual sensors.

Figure 4:
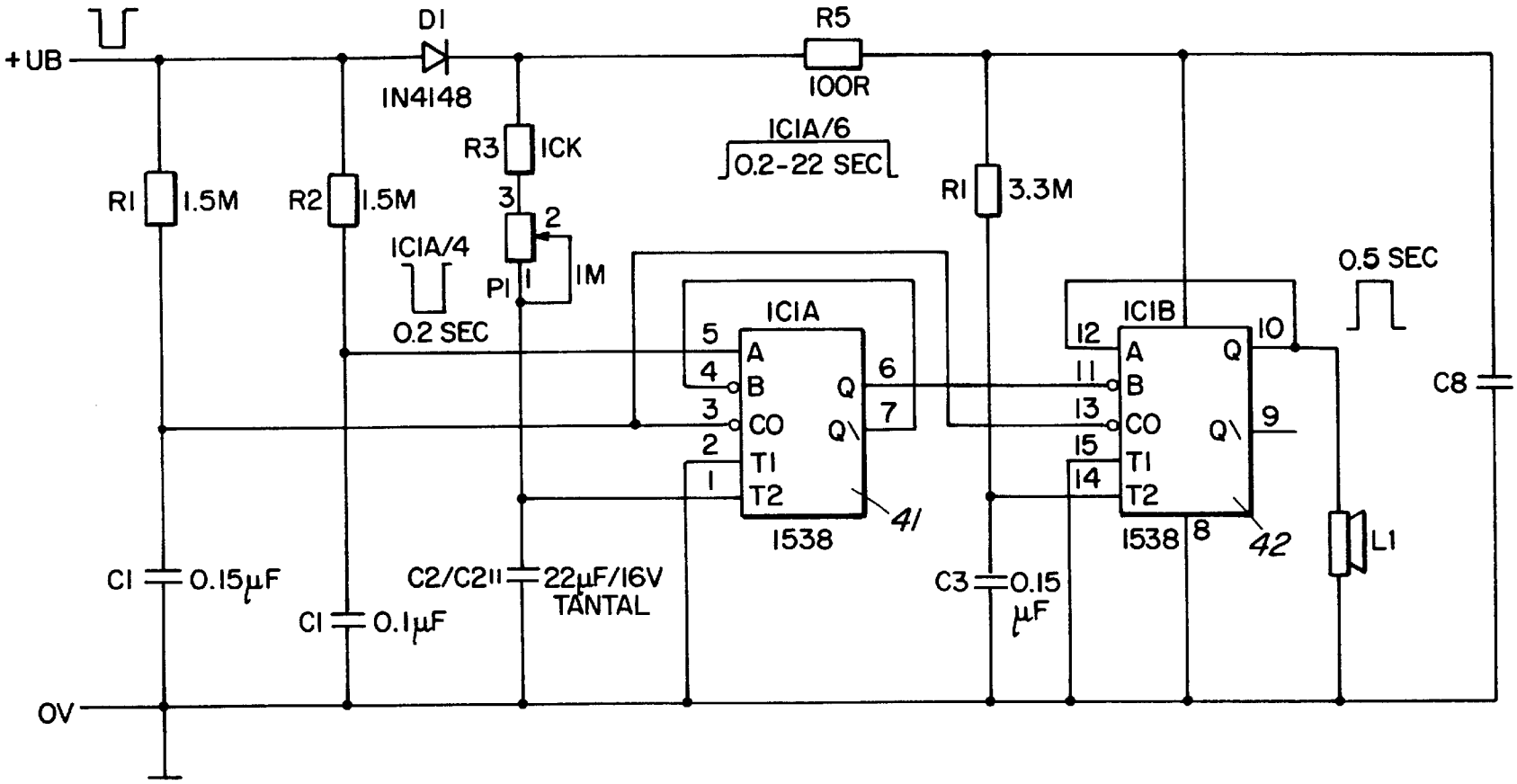
FIG. 4 is a circuit diagram of a preferred embodiment of the self-testing unit.

FIG. 4 shows the preferred embodiments for the circuit of the self testing device, in which a commercially available piezo signal generator L1 is used for the structure-born sound excitation. A monovibrator 41 is used to generate the delay time. Triggered by the output of this monovibrator a second one 42 generates the test signal duration.

The monovibrator 41 is triggered trough the RC-modules R2, C2, which ensures that only a zeroing out of the supply voltage for more than a predetermined time period t, will trigger 41. The RC-module R1, C1 will force a reset and therefore inhibit triggering of 41 if a substantially longer zeroing of the supply voltage is applied. The delay time of 41 is defined by C3, R3 and P1 and adjustable through P1 from 0.3 to 30 seconds.

After elapse of the delay time monoflop 42 is triggered and provides the self test signal duration defined by the RC-module R4, C5.

The capacitor C6 provides a sufficient power supply to operate the system during the zeroing of the supply voltage. Since only 13 component parts are required, the circuit can have a very small construction. By using C-MOS components, the zero-signal current consumption is at approximately 1 $\mu$A. Thus, an integration into a conventional sensor can be carried out without difficulty.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A monitoring device for detecting acoustic vibrations in a monitored object, comprising:

a central electronic analysis unit;

a plurality of sound sensors which are mounted in acoustic communication with said monitored object, each of which is connected to said central electronic analysis unit; and a plurality of self testing units connected to said central electronic analysis unit, each such self testing unit being acoustically coupled with a respective corresponding one of said sound sensors;

wherein (i) said self testing units are activated by said electronic analysis unit by modulation of an operating voltage applied thereto;

(ii) said sound sensors are connected to the analysis unit by way of a common current supply/signal line;

(iii) delay devices are assigned to the individual self testing units whereby testing structure-borne-sound excitation is generated only after a preselectable delay time following an activation of the self testing unit; and (iv) the delay time differs for each of the self-testing units.

2. Monitoring device according to claim 1 wherein said electronic analysis unit is programmed to detect predetermined acoustic vibration patterns.

3. Monitoring device according to claim 2 wherein said predetermined acoustic vibration patterns are indicative of an unauthorized manipulation of said monitored object.

4. Monitoring device according to claim 3 wherein said monitored object is at least one of a window, a door, a window grate, a fence and a fence gate.

5. Monitoring device according to claim 1 wherein each self-testing unit is integrated in a housing of said sound sensor, whereby an acoustic coupling exists directly between the self-testing unit and the housing of the sound sensor.

6. Monitoring device according to claim 1 wherein said self-testing units are arranged outside housings of corresponding sound sensors, and are acoustically coupled to corresponding sound sensors by way of a sound transmitting medium.

* * * * *